US009932746B2

(12) United States Patent
Fox

(10) Patent No.: US 9,932,746 B2
(45) Date of Patent: Apr. 3, 2018

(54) INTEGRAL RETAINING UTILITY STRAP FOR INFLATABLE POOL

(71) Applicant: Alan J. Fox, Grand Ledge, MI (US)

(72) Inventor: Alan J. Fox, Grand Ledge, MI (US)

( * ) Notice: Subject to any disclaimer, the term of this patent is extended or adjusted under 35 U.S.C. 154(b) by 77 days.

(21) Appl. No.: 14/942,273

(22) Filed: Nov. 16, 2015

(65) Prior Publication Data

US 2016/0160518 A1 Jun. 9, 2016

Related U.S. Application Data

(60) Provisional application No. 62/087,019, filed on Dec. 3, 2014, provisional application No. 62/218,638, filed on Sep. 15, 2015.

(51) Int. Cl.
*E04H 4/00* (2006.01)

(52) U.S. Cl.
CPC ..... *E04H 4/0025* (2013.01)

(58) Field of Classification Search
CPC ..... E03H 4/10; E03H 4/0018; E03H 4/0025
USPC ..... 4/496, 500, 506
See application file for complete search history.

(56) References Cited

U.S. PATENT DOCUMENTS

| | | | | |
|---|---|---|---|---|
| 3,707,007 | A * | 12/1972 | Trostler | E04H 4/10 4/500 |
| 5,930,849 | A * | 8/1999 | Marbach | E04H 4/0025 4/488 |
| 6,913,385 | B1 * | 7/2005 | Sagos | E04H 4/0018 383/23 |
| 2016/0108634 | A1 * | 4/2016 | Uphold | E04H 4/10 4/500 |

* cited by examiner

*Primary Examiner* — Huyen Le
(74) *Attorney, Agent, or Firm* — Price Heneveld LLP

(57) ABSTRACT

A utility storage mechanism for an inflatable swimming pool includes a substantially elastic outer wall having a top perimeter, an interior surface of the outer wall defining a fluid-containing interior, the utility storage mechanism comprising a strap adapted to encircle the outer wall proximate the top perimeter, wherein when a tensioning force is placed upon the strap, the strap substantially conforms to elastic movements of the outer wall. At least one bracket is coupled to the strap at a bracket-connection portion, the at least one bracket including a receiving member for receiving at least one pool utility fixture, wherein the bracket is coupled to the bracket-connection portion and is in a substantially abutting relationship with an exterior surface of the outer wall.

16 Claims, 10 Drawing Sheets

INTEGRAL RETAINING UTILITY STRAP FOR INFLATABLE POOL

CROSS-REFERENCE TO RELATED APPLICATION

This application claims priority to and the benefit under 35 U.S.C. § 119(e) of U.S. Provisional Patent Application No. 62/087,019, filed on Dec. 3, 2014, entitled "TENSIONED RETAINING UTILITY STRAP FOR INFLATABLE POOL," and U.S. Provisional Patent Application No. 62/218,638, filed on Sep. 15, 2015, entitled "INTEGRAL RETAINING UTILITY STRAP FOR INFLATABLE POOL," the entire disclosures of which are hereby incorporated herein by reference.

BACKGROUND

The present disclosure relates to inflatable pools, and more specifically, a utility strap for an inflatable pool for holding and storing various pool utility fixtures.

SUMMARY

One aspect of the present disclosure is a utility storage mechanism for an inflatable swimming pool including a substantially elastic outer wall having a top perimeter, an interior surface of the outer wall defining a fluid-containing interior, the utility storage mechanism comprising a strap adapted to encircle the outer wall proximate the top perimeter, wherein when a tensioning force is placed upon the strap, the strap substantially conforms to elastic movements of the outer wall. At least one bracket is coupled to the strap at a bracket-connection portion, the at least one bracket including a receiving member for receiving at least one pool utility fixture, wherein the bracket is coupled to the bracket-connection portion and is in a substantially abutting relationship with an exterior surface of the outer wall.

In another aspect, a utility storage mechanism for an inflatable swimming pool includes a substantially elastic outer wall having a top perimeter. An interior surface of the outer wall defines a fluid-containing interior. The utility storage mechanism comprises an integral anchorage that is integrated with the outer wall proximate the top perimeter. The integral anchorage substantially conforms to elastic movements of the outer wall and defines at least one bracket connection portion, wherein the bracket connection portion is at least one of attached to the outer wall and integrated within the outer wall. The bracket connection portion is defined by a plurality of anchorage receptacles that selectively receive at least one pool utility fixture.

In another aspect, a method for storing pool-related fixtures along an exterior surface of an outer wall of an inflatable pool includes providing a strap configured to be placed around the exterior surface of an inflatable pool proximate a top perimeter of the inflatable swimming pool, wherein the strap includes at least one bracket-connection portion. The method also includes tensioning the strap to allow the strap to conform to the exterior surface of the outer wall of the pool. At least one bracket is provided wherein the at least one bracket is configured to be placed within bracket receptacles of the bracket-connection portion. The various brackets are then placed into the respective bracket receptacles such that each at least one bracket is coupled with the strap and in a substantially abutting relationship with the exterior surface of the outer wall. Each at least one bracket includes a receiving member that defines an engagement area and placing a pool related fixture within the engagement area, wherein the pool related fixtures include at least one of a pool cover, a solar pool cover, a pool toy storage receptacle, pool maintenance equipment, a solar water heater, pool play fixtures, and a ladder.

These and other features, advantages, and objects of the present device will be further understood and appreciated by those skilled in the art upon studying the following specification, claims, and appended drawings.

DETAILED DESCRIPTION

Figure 1:
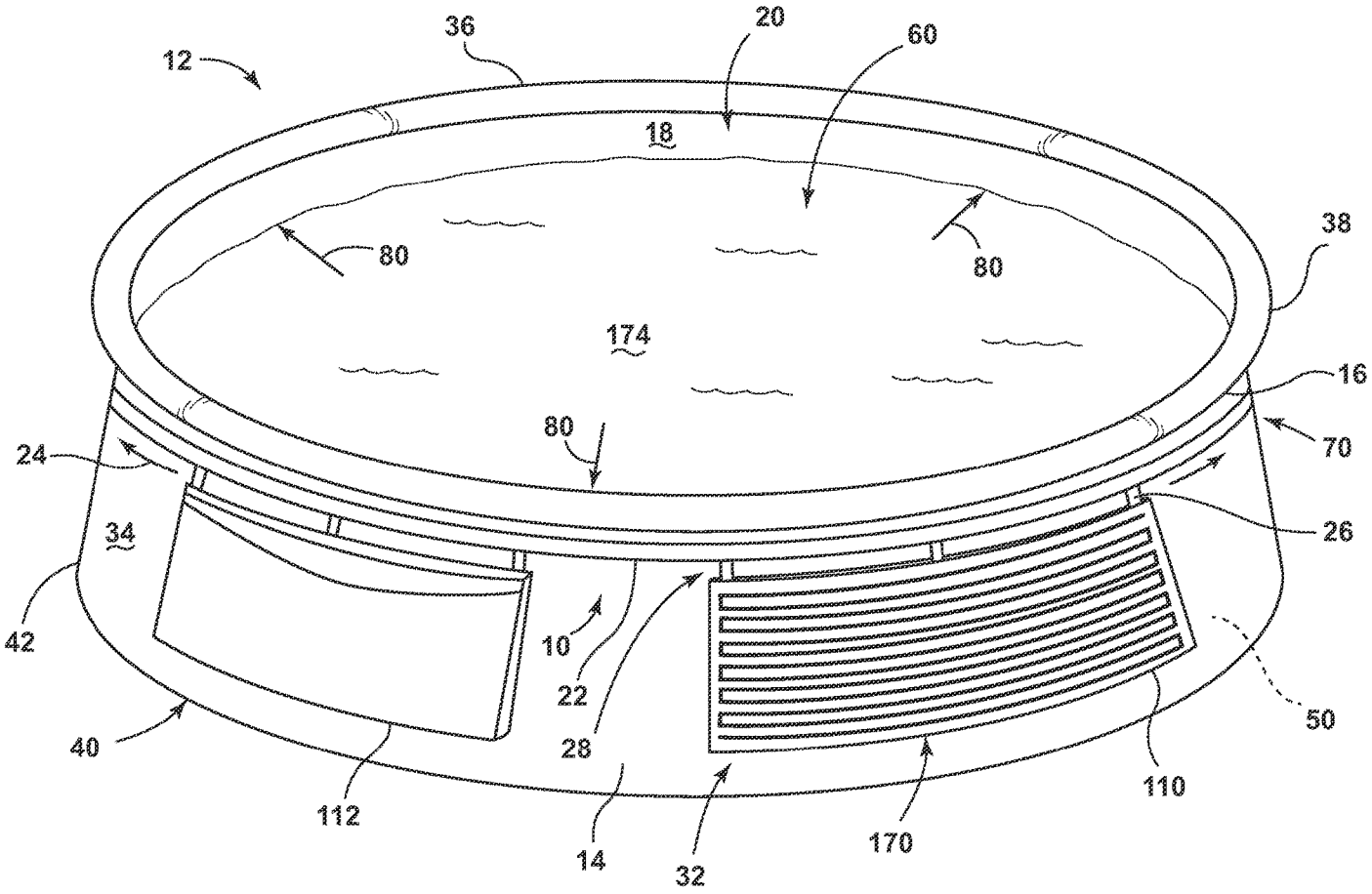
FIG. 1 is a schematic perspective view of the utility storage mechanism shown installed upon an inflatable swimming pool, according to one embodiment, and a plurality of pool utility fixtures disposed thereon.

For purposes of description herein the terms "upper," "lower," "right," "left," "rear," "front," "vertical," "horizontal," and derivatives thereof shall relate to the assembly as oriented in FIG. 1. However, it is to be understood that the device may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

As shown in FIGS. 1-6, reference numeral 10 generally refers to a utility storage mechanism for an inflatable swimming pool 12, where the inflatable swimming pool 12 includes a substantially elastic outer wall 14 having a top perimeter 16, and wherein an interior surface 18 of the outer wall 14 defines a fluid-containing interior 20, according to one embodiment. The utility storage mechanism 10 includes a strap 22 adapted to encircle the outer wall 14 proximate the top perimeter 16 of the outer wall 14. When a tensioning force 24 is placed upon the strap 22, the strap 22 substantially conforms to elastic movements of the outer wall 14. At least one bracket 26 is coupled to the strap 22 at a bracket-connection portion 28, where the at least one bracket 26 includes a receiving member 30 for receiving at least one pool utility fixture 32. The bracket 26 is coupled to the bracket-connection portion 28 and is in a substantially abutting relationship with an exterior surface 34 of the outer wall 14. According to various embodiments, the inflatable swimming pool 12 can include an inflatable ring 36 that extends around the top perimeter 16 of the outer wall 14. In such an embodiment, the outer edge 38 of the inflatable ring 36 is configured to extend beyond the top perimeter 16 of the outer wall 14. It is also contemplated that the outer wall 14 can include a base 40 that defines a bottom perimeter 42, wherein the bottom perimeter 42 is larger than the top perimeter 16. In this manner, the exterior surface 34 of the outer wall 14 defines a generally frusto-conical shape.

According to the various embodiments, inflatable swimming pools 12 are generally oval, circular or rectangular pools that are positioned above ground. The outer walls 14 of the inflatable swimming pools 12 are generally inflated to provide a substantially rigid enclosure to define the fluid-containing interior 20 within which fluid 60 can be disposed for swimming. While the inflated outer walls 14 are substantially rigid, deflection within the outer walls 14 is expected as the outer walls 14 are generally elastic in nature. Accordingly, while the outer walls 14 of the inflatable swimming pool 12 tend to keep their original shape, they are elastic in nature such that the outer walls 14 can deflect outward and inward based upon currents of water within the inflatable swimming pool 12, impacts with swimmers and various fixtures disposed within the inflatable swimming pool 12, and other factors. Because the outer walls 14 of the inflatable swimming pool 12 are filled with gas 50, such as air, certain conventional attachment methods, typically used in non-inflatable swimming pools, are not conducive for use on an inflatable swimming pool 12. Such conventional fastening methods can require the use of screws, bolts, nails and other fastening mechanisms to attach various structures to a non-inflatable swimming pool. It is obvious that placing a screw within the outer wall 14 of an inflatable swimming pool 12 will result in the deflation of the inflatable swimming pool 12, the release of fluid 60, or both, thereby frustrating the purpose of the inflatable swimming pool 12.

According to the various embodiments, inflatable swimming pools 12 can be made of various materials that can include, but are not limited to, plastic, rubber, polyvinyl chloride, various polymers, composite materials, combinations thereof, and other similar elastic-type materials that can be inflated to a substantially rigid but elastic form to be used as an inflatable swimming pool 12. Regardless of the material used, the inflatable swimming pool 12 must be made of a material that can stand the force of hundreds, thousands, or tens of thousands of gallons of water being contained therein. Such vast amounts of water can place very high outward pressures upon the outer walls 14 of the inflatable swimming pool 12, such that the outer walls 14 of the inflatable swimming pool 12 tend to flex in response to the way that the fluid 60 is disposed within the inflatable swimming pool 12. Such outward deflection, over time, may tend to weaken the outer walls 14 of the inflatable swimming pool 12 such that failure may become more likely after prolonged use of the inflatable swimming pool 12.

A convenient feature of various inflatable swimming pools 12 is that the inflatable swimming pool 12, when not in use, can be deflated and packed into a substantially small space for storage during non-use, such as during colder times of the year, off seasons, for storage, or for transportation to another location. As discussed above, the ability to inflate and deflate the inflatable swimming pool 12 also makes it difficult for a user to attach or otherwise hang various pool utility fixtures 32 related to the use and maintenance of the inflatable swimming pool 12 onto the outer walls 14 of the inflatable swimming pool 12. Again, the use of attachment fixtures such as screws, bolts, clamps, nails, and other similar attachment features cannot be used in conjunction with an inflatable swimming pool 12. Additionally, the structure of the inflatable swimming pool 12 is also not conducive for pool utility fixtures 32 to be placed over the upper inflatable ring 36 of the inflatable swimming pool 12 and over the top of the outer wall 14 of the inflatable swimming pool 12. Because of the inflatable and elastic characteristics of the outer walls 14 of inflatable swimming pools 12, downward forces placed upon the outer wall 14 of the inflatable swimming pool 12 can tend to press the outer wall 14 downward. If the outer wall 14 is pressed below the fluid line of the fluid contained within the inflatable swimming pool 12, substantial amounts of fluid 60 can escape the inflatable swimming pool 12 and may cause a complete failure of the system of the inflatable swimming pool 12.

Referring again to the embodiment illustrated in FIGS. 1-6, the utility storage mechanism 10 includes a strap 22 that can be placed around an upper portion 70 of the outer wall 14 near the top perimeter 16 of the outer wall 14. In this manner, the strap 22 can be tensioned around the exterior surface 34 of the outer wall 14 and held in place due to the frusto-conical shape of the outer wall 14 of the inflatable swimming pool 12. As various pool utility fixtures 32 are hung upon the strap 22, the strap 22 is tended downward due to the weight of the various pool utility fixtures 32 being placed upon the strap 22. The frusto-conical shape of the outer wall 14 of the inflatable swimming pool 12 along with the tensioned configuration of the strap 22, prevents the strap 22 from moving substantially downward on the exterior surface 34 of the outer wall 14 of the inflatable swimming pool 12. Additionally, the outward force 80 of the fluid 60 contained within the inflatable swimming pool 12 biases the outer wall 14 in an outward direction. The nature of the fluid 60 contained within the inflatable swimming pool 12 tends to place substantially equal pressure in all directions on the outer wall 14 of the inflatable swimming pool 12. Accordingly, the outward pressure of the fluid 60, the tensioning of the strap 22, and the frusto-conical shape of the outer wall 14 substantially retains the strap 22 in place. Additionally, the strap 22 being placed in tension also tends to support the outer wall 14 such that outward forces 80 of the fluid 60 disposed within the inflatable swimming pool 12, which tend to deflect the outer wall 14 in an outward direction, are at least partially received by the strap 22 extending around the exterior surface 34 of the outer wall 14. In this manner, the strap 22 tends to provide at least some support to the outer wall 14 as it contains the fluid 60 disposed within the fluid-containing interior 20 of the inflatable swimming pool 12.

Referring again to FIGS. 1-6, the utility storage mechanism 10 can include a plurality of brackets 26 that engage a respective bracket receptacle 90 defined within the bracket-connection portion 28 of the strap 22. According to various embodiments, the bracket 26 can be configured to extend downward from the strap 22 and curve upward to form a storage area 92 defined by the receiving members 30 of the various brackets 26 of the utility storage mechanism 10. In this manner, a downward portion 94 of the bracket 26 can be placed in a substantially abutting arrangement with the exterior surface 34 of the outer wall 14. Accordingly, the downward portion 94 of the bracket 26 that is in engagement with the exterior surface 34 of the outer wall 14 simply rests upon the outer wall 14, and, according to various embodiments, may not be directly attached to the outer wall 14. It is also contemplated that the downward extending portion of each bracket 26 can include a padding member 96 that is disposed between the bracket 26 and the exterior surface 34 of the outer wall 14 to substantially limit the degree of engagement between the bracket 26 and the outer wall 14 to minimize the possibility of puncture of the inflatable swimming pool 12 by any one of the brackets 26.

Referring again to FIGS. 1-6, it is contemplated that the storage area 92 of the various brackets 26 of the utility storage mechanism 10 can define a storage area 92 within which the various pool utility fixtures 32 can be disposed. Such pool utility fixtures 32 can include any one or more of a pool cover 110; a solar pool cover; a pool toy storage container, such as a mesh bag, rigid container, or other flexible or inflexible storage receptacle 112; pool maintenance equipment such as replacement filters, pool maintenance chemicals, thermometers, pool skimming equipment, and other various pool maintenance fixtures; a solar water heater; pool play or recreational fixtures, such as flotation devices, life vests, balls, hoops, baskets, foam flotation devices, inflatable flotation devices, pool-type games, and other recreational equipment; ladders; patching equipment for the inflatable pool; storage equipment for the inflatable swimming pool 12 when deflated and other various pool-related fixtures and equipment.

Referring again to FIGS. 1-6, the strap 22 can include an elongated member having first and second ends 120, 122 where each of the first and second ends 120, 122 includes a strap-connection feature 124 that is configured to connect the first and second ends 120, 122 of the strap 22 to place the tensioning force 24 on the strap 22 as it extends around the exterior surface 34 of the outer wall 14 of the inflatable swimming pool 12. In such embodiments, the strap-connection feature 124 can include a hook-and-loop mechanism, snaps, buttons, ties, hooks, hasps, clasps, and other similar connection mechanisms. It is also contemplated that the strap 22 can include a mechanism for increasing or decreasing the amount of tension placed upon the strap 22, where such tensioning mechanisms can include a ratchet-type mechanism, various slipping-type knots, and other similar tensioning mechanisms. According to various alternate embodiments, the strap 22 can be a substantially elastic member in the form of a continuous loop that can be stretched to be extended around the inflatable ring 36 of the inflatable swimming pool 12 and be tensioned against a portion of the exterior surface 34 of the outer wall 14 of the inflatable swimming pool 12. In embodiments that include a strap 22 having a single continuous loop, it is contemplated that the circumference of the loop is at least slightly smaller than the top perimeter 16 of the outer wall 14. In this manner, the strap 22, being a substantially elastic member in this embodiment, will tend to place the tensioning force 24 upon the outer wall 14 of the inflatable swimming pool 12.

According to the various embodiments, the strap 22 of the utility storage mechanism 10 can be positioned upon the exterior surface 34 of the outer wall 14 of the inflatable swimming pool 12 by a single person by hand without the use of tools. Additionally, the various brackets 26 can be disposed within the strap 22, either before or after the strap 22 is disposed upon the exterior surface 34 of the outer wall 14 of the inflatable swimming pool 12. Additionally, the various brackets 26 can be disposed upon the strap 22 by hand and without the use of tools by a single individual.

Referring again to FIGS. 2-4, each bracket 26 can include an attachment portion 140 that is configured to be engaged with a bracket receptacle 90 of the bracket-connection portion 28 of the strap 22. According to the various embodiments, the bracket receptacle 90 can include at least one pocket 142 defined within the strap 22, where the pocket 142 can be formed out of an additional fabric member attached to the strap 22 such that the pockets 142 are defined between the strap 22 and the additional fabric member. It is contemplated that attachment portions 140 of each bracket 26 can be disposed within the one or more pockets 142 of each bracket receptacle 90 such that the bracket receptacle 90 can retain the attachment portions 140 of each of the brackets 26 in place to define the storage area 92 of the utility storage mechanism 10. In addition to pockets 142, each bracket receptacle 90 can include various alternate retaining features for attachment portions 140 of each bracket 26 to the strap 22. Such retaining features can include, but are not limited to, ties, hooks, secondary straps, hook and loop connectors, and other similar retention features. It is also contemplated that to create the pocket 142 that defines the various bracket receptacles 90, a portion of the strap 22 can be folded, rolled, or otherwise formed into a substantially tubular form to create the pocket 142 used to receive the attachment portion 140 of each bracket 26. In such an embodiment, an additional piece of fabric would not be necessary to form the pocket 142 of the bracket receptacle 90.

According to the various embodiments, the bracket 26 can be made of various materials that can include, but are not limited to, plastic, PVC, various other polymers, composite materials, metal, ceramic, combinations thereof, and other similar substantially rigid materials that can be used to form the storage area 92 out of the plurality of brackets 26 that are attached to the bracket-connection portion 28 of the strap 22. It is also contemplated that the strap 22 can be made of various materials that can include, but are not limited to, nylon, cotton, rubber, latex, plastic, metal reinforced material, other similar fibrous material, structural tape, cable, combinations thereof, and other similar materials that can be used to form the strap 22 that can be tensioned around the exterior surface 34 of the outer wall 14 of the inflatable swimming pool 12. It is contemplated that the choice of materials for the strap 22 can be determined based upon how the strap 22 is affixed to the inflatable swimming pool 12.

According to the various embodiments discussed above, where the strap 22 is a substantially elastic member that is stretched over a top portion of the inflatable swimming pool 12, the strap 22 is contemplated to be a substantially elastic material that can be stretched over a portion of the inflatable swimming pool 12. In various alternate embodiments, where the strap 22 is extended around the exterior surface 34 of the outer wall 14 of the inflatable swimming pool 12, the strap 22 may be a less flexible or more inflexible-type material that is less susceptible to stretching.

Figure 7:
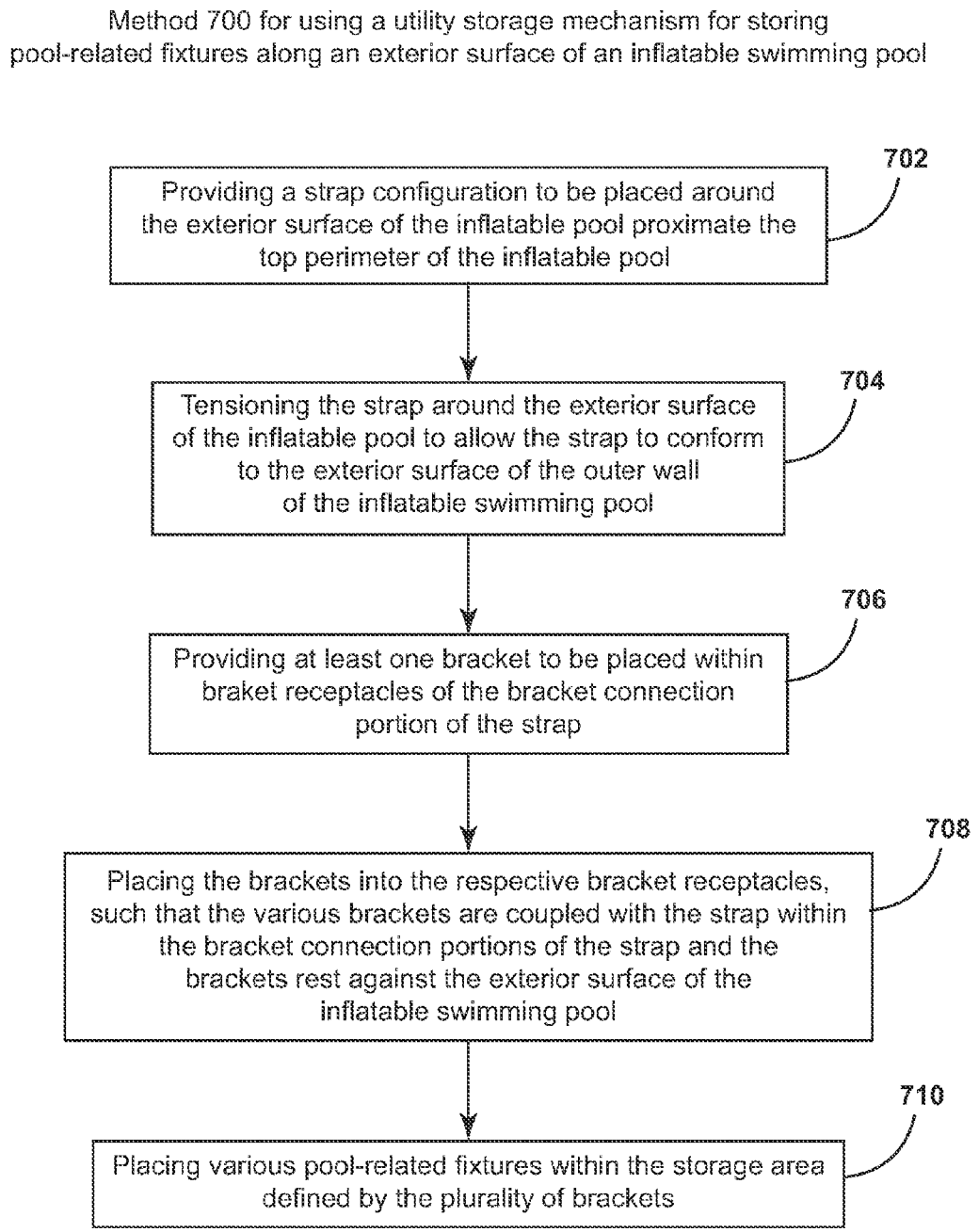
FIG. 7 is a schematic flow diagram illustrating a method for storing pool-related fixtures along an exterior surface of an outer wall of an inflatable pool.
Figure 8:
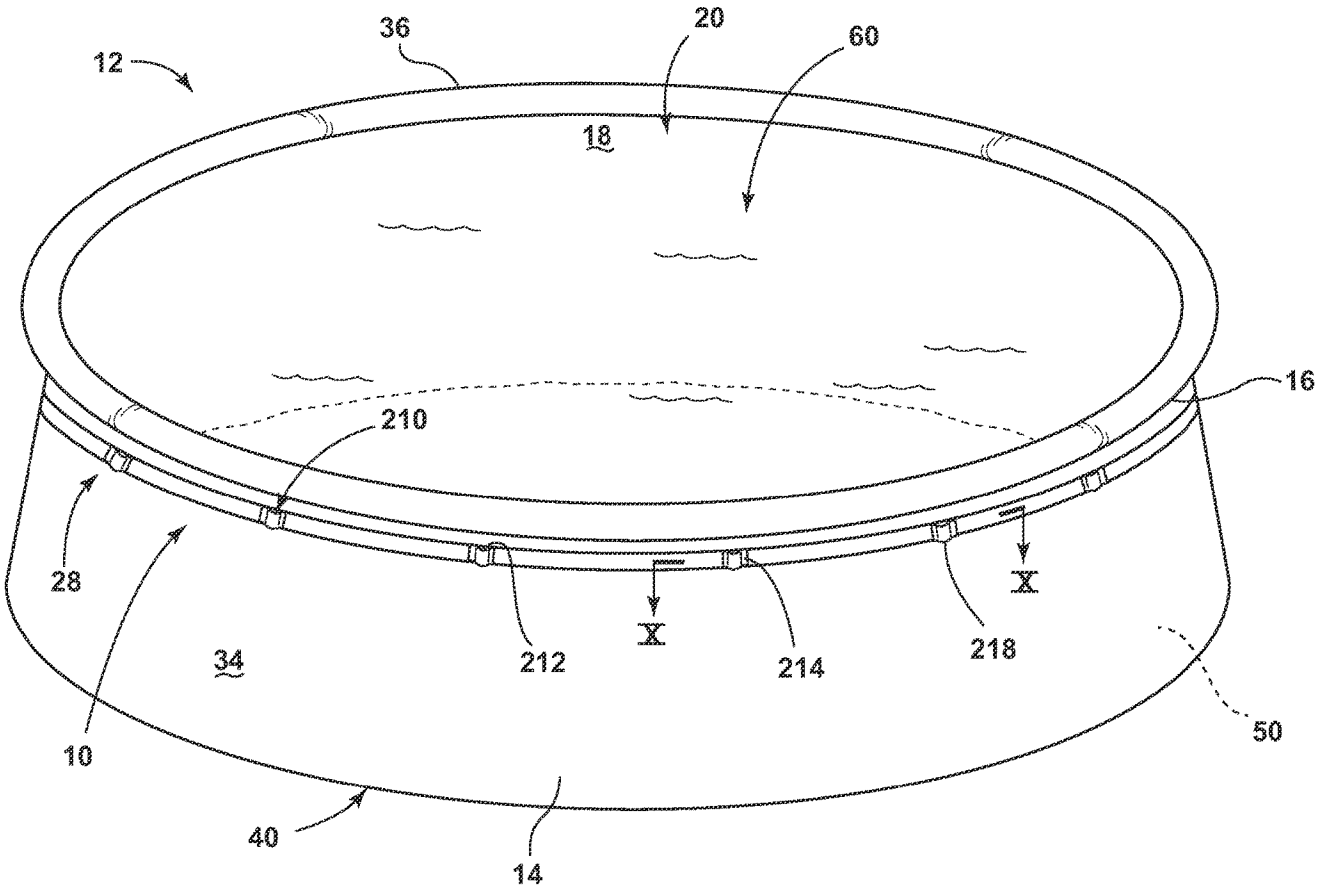
FIG. 8 is a schematic perspective view of an alternate aspect of the utility storage mechanism shown integrated within the outer wall of the inflatable swimming pool.

Referring now to FIG. 7, having described the various embodiments of the utility storage mechanism 10 for the inflatable swimming pool 12, a method 700 is disclosed for using a utility storage mechanism 10 for storing pool-related fixtures along an exterior surface 34 of the outer wall 14 of the inflatable swimming pool 12. According to the various steps of the method 700, a strap 22 is provided, wherein the strap 22 is configured to be placed around the exterior surface 34 of the inflatable swimming pool 12 proximate the top perimeter 16 of the inflatable swimming pool 12 (step 702). As discussed above, the strap 22 can include at least one bracket-connection portion 28 for receiving the various brackets 26 of the utility storage mechanism 10. The strap 22 is then tensioned around the exterior surface 34 of the inflatable swimming pool 12 to allow the strap 22 to conform to the exterior surface 34 of the outer wall 14 of the inflatable swimming pool 12 (step 704). In this manner, as various portions of the outer wall 14 of the inflatable swimming pool 12 deflect inward or outward, depending upon the various outward forces 80 exerted upon the outer wall 14, the flexible nature of the strap 22 allows the strap 22 to conform to the shape and deflect with the outer wall 14 such that the strap 22 remains in tension against the exterior surface 34 of the outer wall 14 and does not tend to slide downward or otherwise loosen against the exterior surface 34 of the outer wall 14 of the inflatable swimming pool 12. At least one bracket 26 is provided and is configured to be placed within the bracket receptacles 90 of the bracket-connection portion 28 (step 706). It is contemplated that the bracket 26 can include a single attachment portion 140 that attaches to the bracket-connection portion 28, and each bracket 26 can include one or more receiving members 30 for receiving the various pool utility fixtures 32.

In various alternate embodiments, a plurality of brackets 26 can be attached to the bracket-connection portion 28 of the strap 22 and each bracket 26 can include one or more receiving members 30, where the various receiving members 30 of the one or more brackets 26 defines the storage area 92 of the utility storage mechanism 10. Once the brackets 26 are provided, each of the brackets 26 is placed into respective bracket receptacles 90, such that the various brackets 26 are coupled with the strap 22 within the bracket-connection portions 28 of the strap 22 (step 708). Additionally, a downward portion 94 of the bracket 26 is configured to be in a substantially abutting relationship with the exterior surface 34 of the outer wall 14 of the inflatable swimming pool 12. Again, each of the brackets 26 includes the receiving members 30 that defines an engagement area that can be configured to be the storage area 92 for the plurality of brackets 26. The receiving members 30 can also be configured to hold various hanging fixtures such as bags, containers, and other hangable pool-related equipment. Once the brackets 26 are disposed in the strap 22 and the strap 22 is tensioned around the exterior surface 34 of the outer wall 14 of the inflatable swimming pool 12, the utility storage mechanism 10 for the inflatable swimming pool 12 is in place and the various pool-related fixtures can be placed within the engagement area of the utility storage mechanism 10 (step 710).

According to the various embodiments, as illustrated in FIGS. 1-6, the receiving members 30 can be hook-shaped members that extend upward to define the storage area 92. In addition, it is contemplated that the receiving members 30 can extend between adjacent brackets 26 to position the brackets 26 and further define the storage area 92 of the utility storage mechanism 10. It is also contemplated that the receiving members 30 can include other shapes and geometries that are configured to hold, secure or otherwise retain various pool utility fixtures 32 within or around the storage area 92.

According to the various embodiments, the utility storage mechanism 10 and the various embodiments of the utility storage mechanism 10 described herein, are configured to provide an engagement area proximate the exterior surface 34 of the outer wall 14 of the inflatable swimming pool 12. Additionally, the utility storage mechanism 10 is configured to provide a system that is substantially free of potential puncturing implements while also providing a sufficient structural mechanism upon which the various pool utility fixtures 32 can be placed. The utility storage mechanism 10 also provides a location for storage of the various pool utility fixtures 32 upon the inflatable swimming pool 12 itself, without requiring additional storage area 92 beyond the inflatable swimming pool 12 during use of the inflatable swimming pool 12. Accordingly, the various pool utility fixtures 32 can be positioned relatively at hand during use of the inflatable swimming pool 12.

Figure 2:
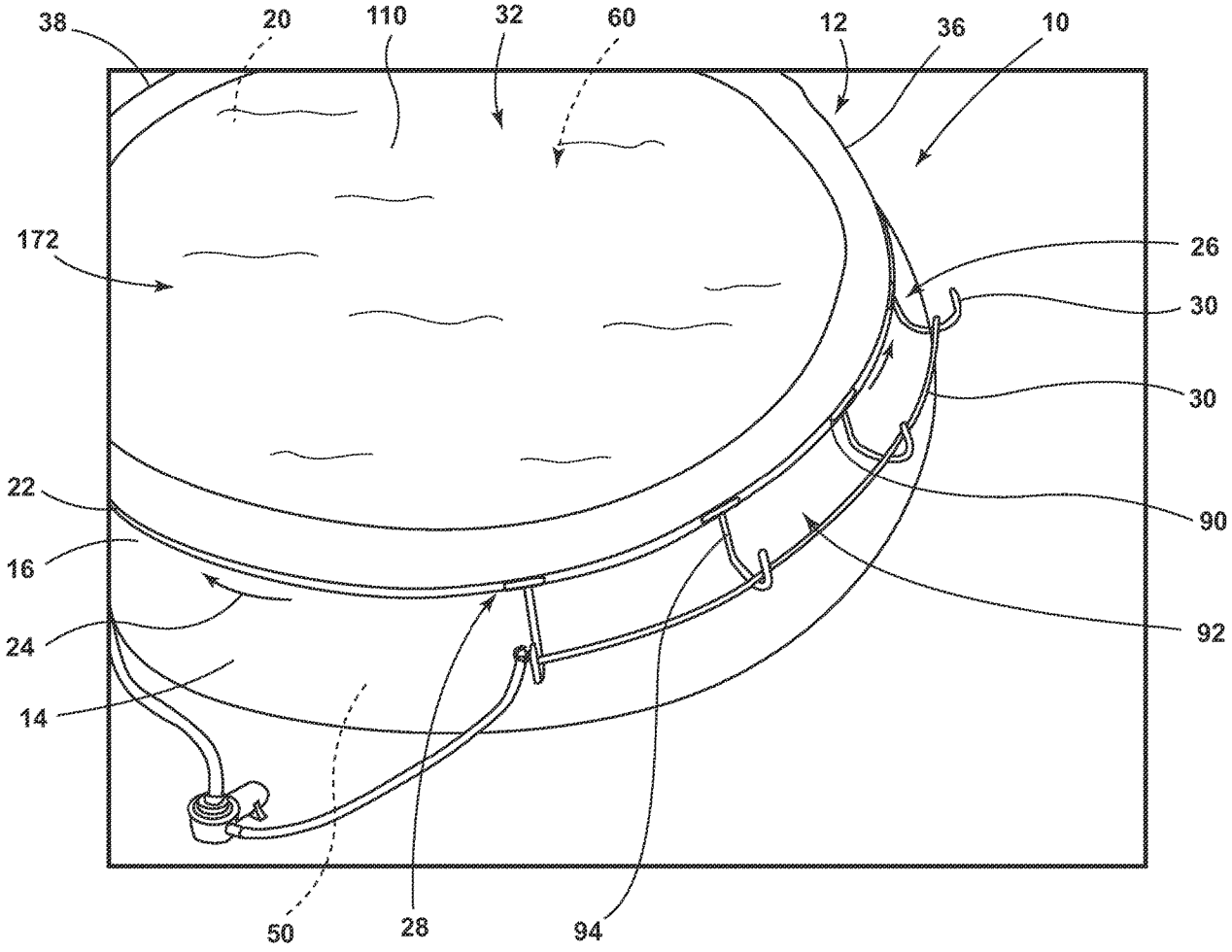
FIG. 2 is a top perspective view of an alternate embodiment of the utility storage mechanism shown installed upon an inflatable pool and showing the pool utility fixture when in use.
Figure 3:
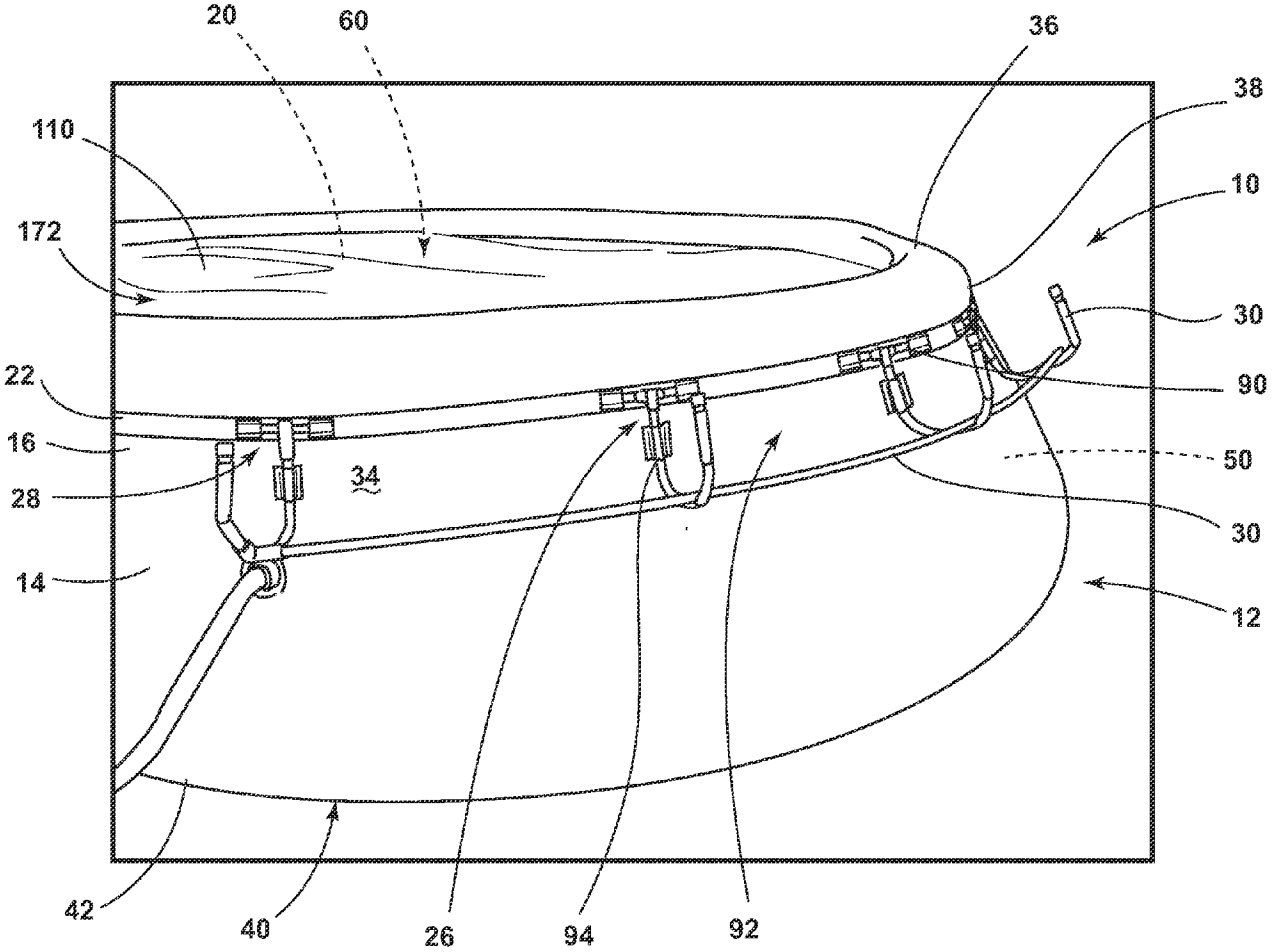
FIG. 3 is a side perspective view of the utility storage mechanism of FIG. 2.
Figure 4:
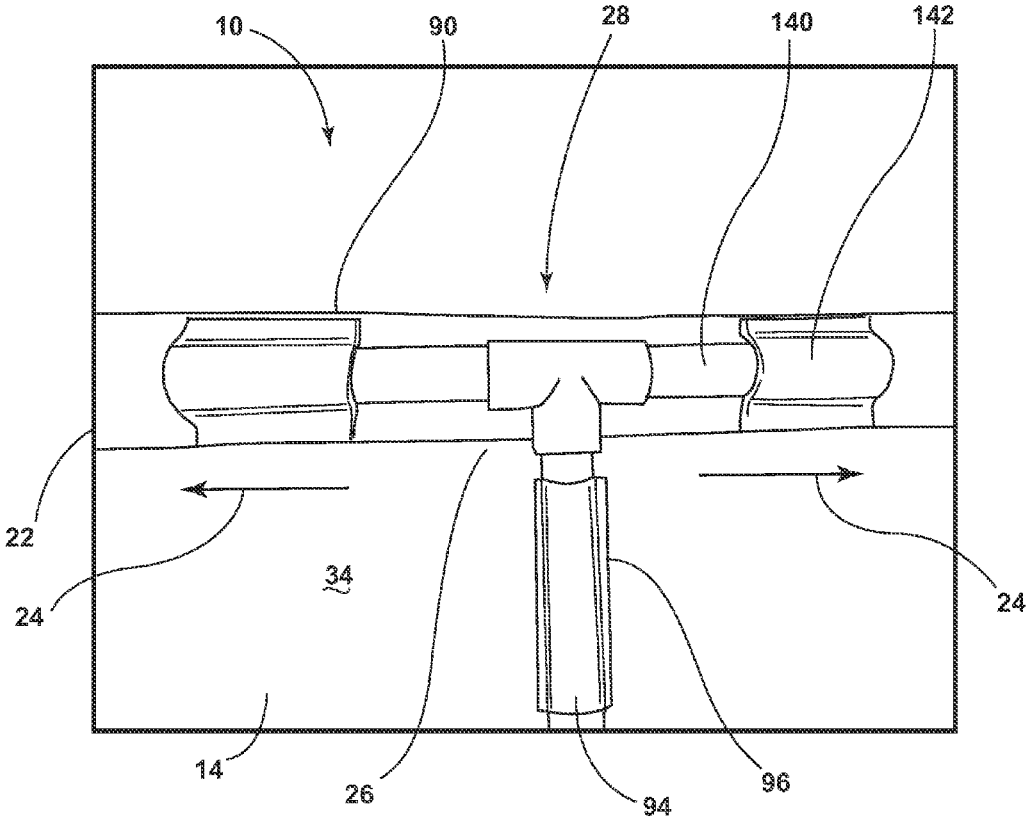
FIG. 4 is a detail elevational view of a bracket for the utility storage mechanism engaging a bracket-connection portion of the strap, according to one embodiment.
Figure 5:
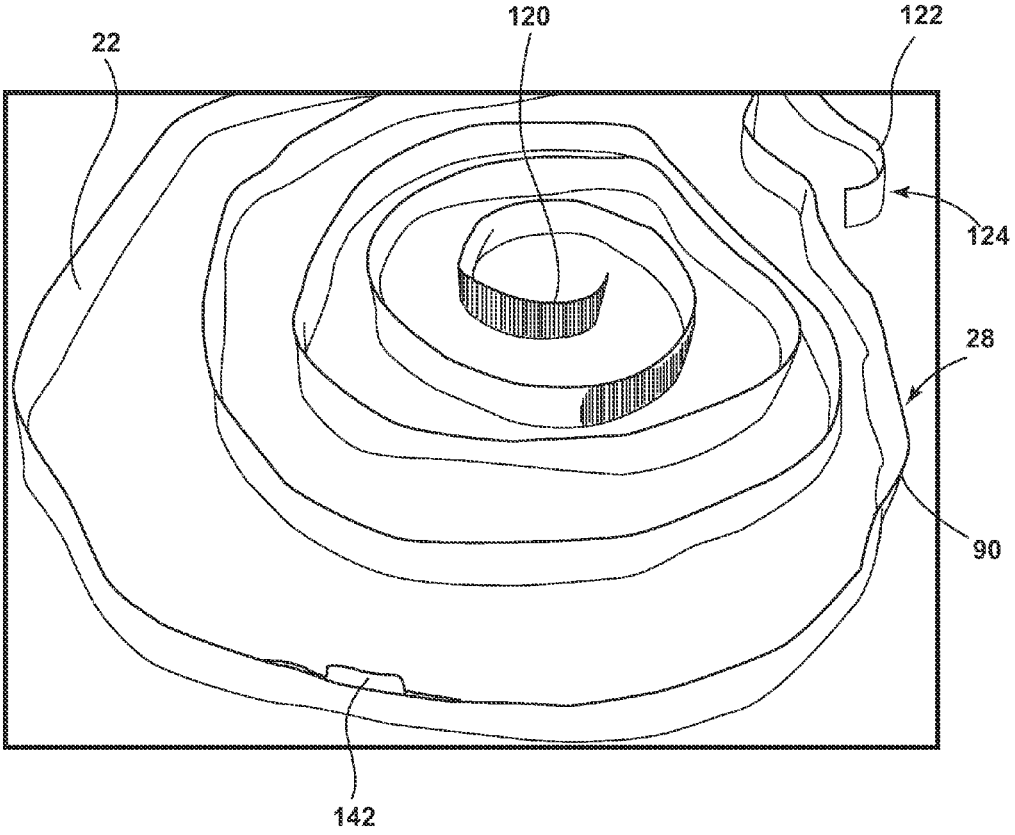
FIG. 5 is a top perspective view of a strap for an alternate embodiment of the utility storage mechanism.
Figure 6:
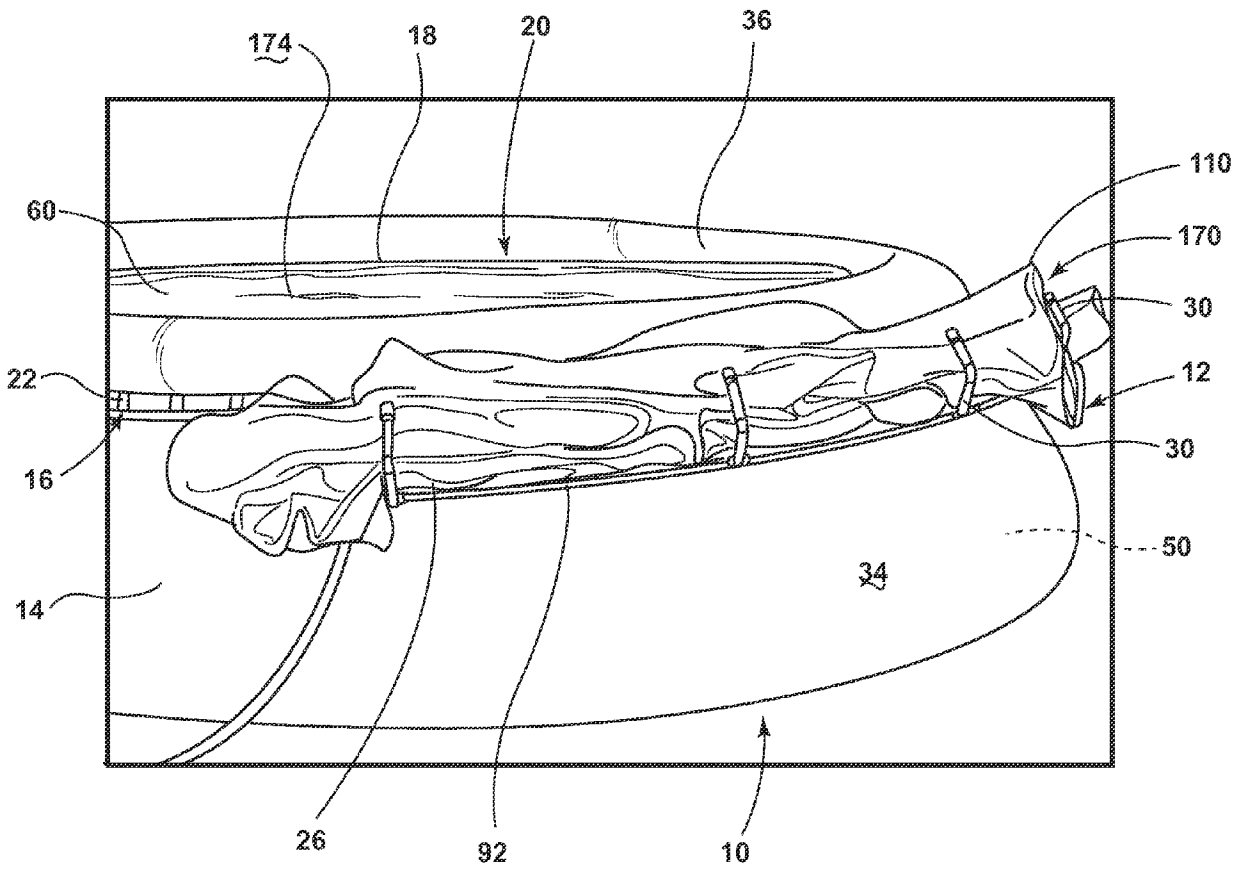
FIG. 6 is a side perspective view of the utility storage mechanism of FIG. 2 with the pool utility fixture disposed within the storage area defined by the plurality of brackets of the utility storage mechanism.

As illustrated in FIGS. 2, 3 and 6, in use, the utility storage mechanism 10 can be used to store various pool utility fixtures 32, such as the pool cover 110 (shown in FIGS. 2, 3 and 6). As illustrated in FIG. 6, the pool cover 110 can be disposed in a stowed position 170 within the engagement area of the various brackets 26 of the utility storage mechanism 10, such that the inflatable swimming pool 12 can be used without the pool cover 110 touching the ground and becoming soiled or otherwise accumulating dirt that may be transferred into the water disposed within the inflatable swimming pool 12. Once various recreational activities are completed within the inflatable swimming pool 12, the pool cover 110 is readily at hand within the engagement area of the utility storage mechanism 10 and can be conveniently moved to a covering position 172 defined by the pool cover 110 being spread across the top surface 174 of the fluid 60 within the inflatable swimming pool 12. Accordingly, the various pool utility fixtures 32 can be suspended off of the ground and also readily at hand for use during various recreational activities within the inflatable swimming pool 12. Accordingly, substantial amounts of dirt, grass, and other debris can be kept away from the inflatable swimming pool 12 due to the suspension of the various pool utility fixtures 32 above the ground within the engagement area of the utility storage mechanism 10. It is contemplated that the various pool utility fixtures 32, including, but not limited to, the pool cover 110, can be moved between the stowed and covering positions 170, 172, and vice versa, by hand and without the use of tools. This movement between the stowed and covering positions 170, 172 can also be performed by a single individual.

Referring now to an alternate aspect of the utility storage mechanism 10 for an inflatable swimming pool 12, according to the various embodiments, as exemplified in FIGS. 8-11, a bracket-connection portion 28 of the utility storage mechanism 10 can be integrated within the outer walls 14 of the inflatable swimming pool 12. It is contemplated that such an integrated bracket-connection portion 28 can be defined by an integral anchorage 210 that is directly attached to, or integrated as part of, the exterior surface 34 of the outer wall 14 of the inflatable swimming pool 12. Such an integral anchorage 210 can be manufactured within the material of the outer walls 14, or can be adhered thereto during manufacture as a separate piece and permanently affixed as a portion of the outer wall 14 of the inflatable swimming pool 12. Additionally, the integral anchorage 210 of the utility storage mechanism 10 can include a plurality of anchorage receptacles 212 that can be affixed in a predetermined orientation, such as vertical or horizontal for receiving various brackets 26 for holding pool utility fixtures 32 or for directly attaching various pool utility fixtures 32 to the exterior surface 34 of the inflatable swimming pool 12.

Referring again to FIGS. 8 and 10, the utility storage mechanism 10 can include a plurality of integral anchorages 210 that extend around the exterior surface 34 of the outer wall 14 of the inflatable swimming pool 12. A belt member 214 can extend around a portion of or the entire outer wall 14 of the inflatable swimming pool 12 to provide various points or positions defined by the anchorage receptacles 212 at which the various pool utility fixtures 32 can be attached. By way of example, and not limitation, a pool utility fixture 32, such as a storage receptacle 112, can be hung from the belt member 214 extending between the various integral anchorages 210 of the utility storage mechanism 10. Alternatively, a bracket 26 or other pool utility fixture 32 can be attached directly to one or more anchorage receptacles 212 and/or the belt member 214 extending therebetween. In this manner, the belt member 214 and the anchorage receptacles 212 can cooperate to define various lateral and vertical loops, holes, or other fastening fixtures to which the pool utility fixtures 32 can be attached. As discussed above, the belt member 214 that extends between the plurality of integral anchorages 210 can apply the tensioning force 24 around the exterior surface 34 of the outer wall 14 of the inflatable swimming pool 12.

Referring again to FIGS. 8 and 10, it is contemplated that the belt member 214 and integral anchorages 210 can be made of the same material as the outer wall 14 of the inflatable swimming pool 12. In this manner, the integral anchorages 210 can be molded into the material of the outer wall 14 of the inflatable swimming pool 12 and can define various inward extending cavities 216 (exemplified in FIG. 11), or outward extending protrusions 218. The inward extending cavities 216 can include an additional anchorage member 220 (exemplified in FIG. 11) that extends across the cavity 216 to provide a place to which the various pool utility fixtures 32 can attach within the anchorage receptacle 212. Where the integral anchorage 210 extends outward to form the anchorage protrusion 218, it is contemplated that the anchorage protrusion 218 can include an anchorage member 220 that is defined within the protrusion 218 or that extends outward from the exterior surface 34 of the outer wall 14 of the inflatable swimming pool 12. The various anchorage members 220 can include any one of various physical features for connecting the pool accessory fixtures, where such members can include, but are not limited to, hooks, rings, clips, holes, loops, bars, clasps, hasps, belts, toggles, combinations thereof, and other various retaining fixtures that can serve to form the integral anchorage 210 and the anchorage receptacle 212 defined therein or thereby.

Figure 9:
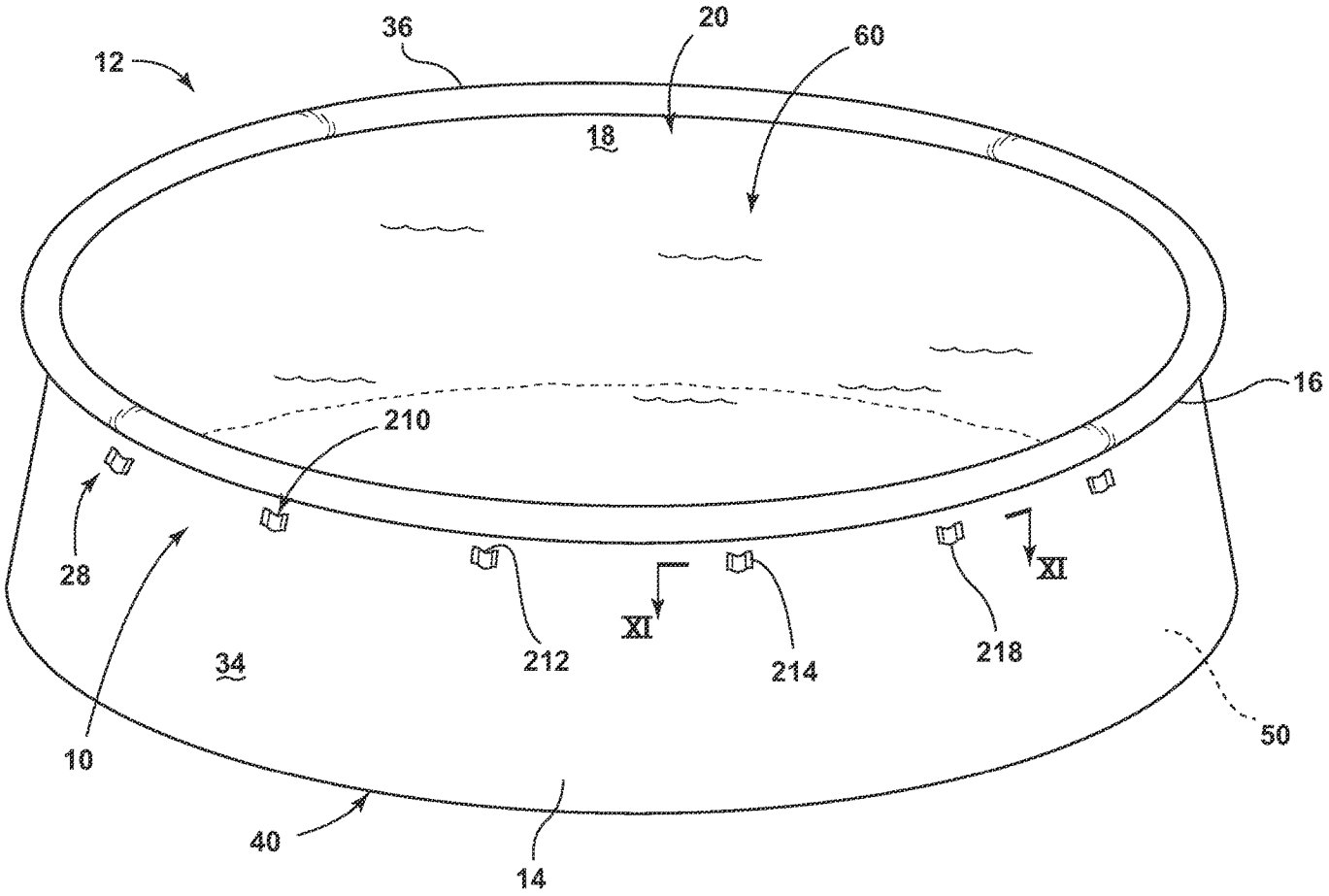
FIG. 9 is a schematic perspective view of another aspect of the utility storage mechanism shown incorporated within an outer wall of the inflatable swimming pool.
Figure 10:
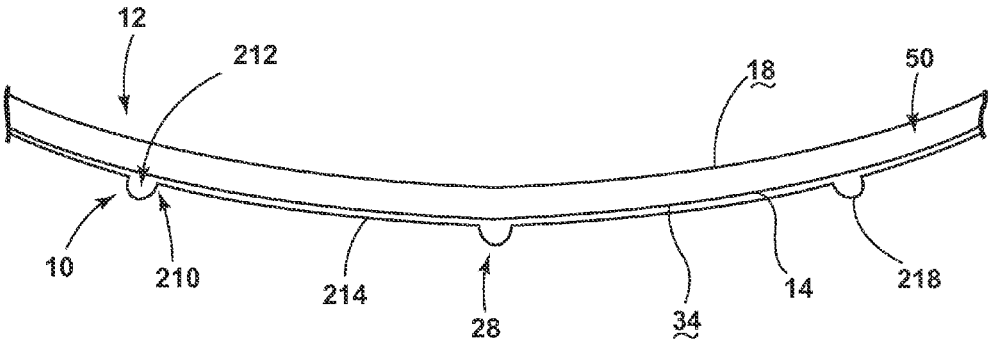
FIG. 10 is a lateral cross-sectional view of the inflatable swimming pool of FIG. 8 taken along line X-X.
Figure 11:
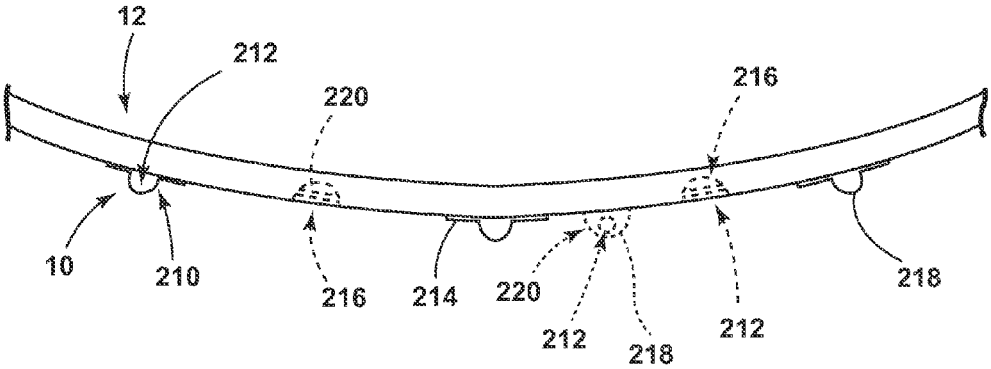
FIG. 11 is a lateral cross-sectional view of the inflatable swimming pool of FIG. 9 taken along line XI-XI.

Referring now to FIGS. 9 and 11, it is contemplated that the utility storage mechanism 10 can be defined by the plurality of integral anchorages 210 that extend around the exterior surface 34 of the outer wall 14 in a spaced configuration. In such an embodiment, each of the integral anchorages 210 can be situation in a spaced-apart configuration at regular or irregular intervals and at a consistent height or varying heights. According to the various embodiments, each of the integral anchorages 210 that are positioned around the exterior surface 34 of the outer wall 14 can be individual portions of a belt member 214 that are adhered to the exterior surface 34 of the outer wall 14. In this manner, each individual belt member 214 can be adhered to the exterior surface 34 at opposing ends such that a slackened central portion can extend outward from the exterior surface 34 of the outer wall 14 to form an opening or loop to which a bracket 26 or other pool utility fixture 32 can be attached. As discussed above, each of the integral anchorages 210 of the utility storage mechanism 10 can be set within as an anchorage cavity 216 or can extend outward as an anchorage protrusion 218 to define the anchorage receptacle 212. Typically, where the integral anchorage 210 extends inward and into a portion of the outer wall 14 to form a cavity 216, the integral anchorage 210 is formed as part of the material of the outer wall 14 of the inflatable swimming pool 12. It is contemplated that certain reinforcing mechanisms or thickened portions of the outer wall 14 can be incorporated to form an aspect of the anchorage cavity 216 to strengthen portions of the integral anchorage 210 for supporting the pool utility fixtures 32 attached thereto. Such additional material can be a solid piece of rubber, plastic, or a thickened portion of the material of the outer wall 14 of the inflatable swimming pool 12.

According to the various embodiments, where the integral anchorage 210 extends outward from the exterior surface 34 of the outer wall 14, the anchorage protrusion 218 can be formed as part of the outer wall 14 during manufacture. As discussed previously, the anchorage protrusion 218 can also be a separate member that is adhered or otherwise affixed to the exterior surface 34 of the outer wall 14 to form the integral anchorage 210 and the anchorage protrusion 218.

Referring again to FIGS. 8-11, it is contemplated that the integral anchorage 210 can be a single belt member 214 that extends around the exterior surface 34 of the outer wall 14 or certain portions of the belt member 214 are directly attached, through adhesives, sonic welding, water-tight fasteners, combinations thereof, or other similar fastener that can work in conjunction with an inflatable swimming pool 12 to maintain a water tight interface. In such an embodiment, the portions of the belt member 214 that extend around the exterior surface 34 of the outer wall 14 can remain unattached to the exterior surface 34 such that they can be at least partially separated from the exterior surface 34 to form a loop, hole, or other integral anchorage 210 of the utility storage mechanism 10. In this manner, the belt member 214 can form slackened portions at various intervals to form the integral anchorages 210. It is also contemplated that the material of the belt member 214 can be at least partially elastic such that when the utility storage mechanism 10 is not in use, the belt member 214 remains closely positioned next to the exterior surface 34 of the outer wall 14. When the belt member 214 is needed to act as the integral anchorage 210, the portion of the belt member 214 that is unattached to the exterior surface 34 of the outer wall 14 can be stretched away from the outer wall 14, and/or a portion of the outer wall 14 can be pressed inward to define the loop, hole, or other type of anchorage receptacle 212 for attaching the pool utility fixtures 32 to the integral anchorage 210 defined between the belt member 214 and the exterior surface 34 of the outer wall 14 of the inflatable swimming pool 12.

According to the various embodiments, the integral anchorages 210 can be included as a portion of the inflatable swimming pool 12 and can be attached thereto during manufacture. Alternatively, it is contemplated that the various integral anchorages 210 can be attached to the exterior surface 34 of the outer wall 14 of the inflatable swimming pool 12 after market, such as a dealer of inflatable swimming pools 12 or by a user of an inflatable swimming pool 12. It is contemplated that the installation, formation or other integration of the integral anchorages 210 within the outer wall 14, whether part of the belt member 214 or not, can be included as part of the various methods of manufacture or modification of the various embodiments of the inflatable swimming pool 12.

As discussed above, each of the integral anchorages 210 that define the various anchorage receptacles 212 can be defined by a belt member 214 that extends around the exterior surface 34 of the outer wall 14 of the inflatable swimming pool 12. The integral anchorages 210 can also be defined by inward extending receptacle cavities 216 that extend inward from the exterior surface 34 of the outer wall 14 of the inflatable swimming pool 12. The integral anchorages 210 can also be defined by outward extending anchorage protrusions 218, or by individual belt portions that are adhered, welded or otherwise integrated into the exterior surface 34 of the outer walls 14 of the inflatable swimming pool 12. It is also contemplated that the utility storage mechanism 10 can include combinations of these types of integral anchorages 210. In such an embodiment, the integral anchorages 210 can be formed by a belt member 214 that extends around the outer wall 14 of the inflatable swimming pool 12 and is adhered to, welded, or otherwise integrated at various portions to define the anchorage receptacles 212 therebetween. At different heights along the outer wall 14, either above or below the belt member 214, individual and spaced anchorage members 220 can be integrally formed within the exterior surface 34 of the outer wall 14 of the inflatable swimming pool 12. In this manner, the various pool utility fixtures 32 can be set at different heights upon the exterior surface 34 of the outer wall 14 of the inflatable swimming pool 12. Additionally, various pool utility fixtures 32 can be attached not just at a top edge but also at a top edge, middle portion, bottom edge and other various portions of the pool utility fixture 32 for securing the pool utility fixture 32 to the outer wall 14 of the inflatable swimming pool 12.

According to the various embodiments, the integral anchorages 210 of the utility storage mechanism 10 can be made of the same material as the outer wall 14 of the inflatable swimming pool 12, or can be formed as integral portions of the outer wall 14 of the inflatable swimming pool 12. It is also contemplated that the integral anchorages 210 can be formed as separate members made of a different material that are adhered to, welded, affixed or otherwise attached to portions of the exterior surface 34 of the outer wall 14 of the inflatable swimming pool 12.

It is also important to note that the construction and arrangement of the elements of the device as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present device. The exemplary structures and processes disclosed herein are for illustrative purposes and are not to be construed as limiting.

It is also to be understood that variations and modifications can be made on the aforementioned structures and methods without departing from the concepts of the present device, and further it is to be understood that such concepts are intended to be covered by the following claims unless these claims by their language expressly state otherwise.

The above description is considered that of the illustrated embodiments only. Modifications of the device will occur to those skilled in the art and to those who make or use the device. Therefore, it is understood that the embodiments shown in the drawings and described above is merely for illustrative purposes and not intended to limit the scope of the device, which is defined by the following claims as interpreted according to the principles of patent law, including the Doctrine of Equivalents.

What is claimed is:

1. A utility storage mechanism for an inflatable swimming pool, the inflatable swimming pool including a substantially elastic, frusto-conical outer wall having a top perimeter, an interior surface of the frusto-conical outer wall defining a fluid-containing interior, the utility storage mechanism comprising:

a strap adapted to encircle the frusto-conical outer wall proximate the top perimeter, wherein when a tensioning force is placed upon the strap, the strap is configured to substantially conform to elastic movements of the frusto-conical outer wall, wherein the strap is further configured to provide increased tensioning force in response to a downward movement of the strap against the frusto-conical outer wall; and at least one bracket coupled to the strap at a bracket receptacle that includes at least one pocket that is integrally formed into the strap, the at least one bracket including a receiving member for receiving at least one pool utility fixture, wherein the at least one bracket is received within the at least one pocket of the bracket receptacle and is configured to be in a substantially abutting relationship with an exterior surface of the frusto-conical outer wall, and wherein the receiving member defines an engagement area that selectively receives the at least one pool utility fixture.

2. The utility storage mechanism of claim 1, further comprising:

an inflatable ring extending around the top perimeter of the frusto-conical outer wall, wherein an outer edge of the inflatable ring extends beyond the top perimeter.

3. The utility storage mechanism of claim 1, wherein the frusto-conical outer wall includes a base defining a bottom perimeter, wherein the bottom perimeter is larger than the top perimeter.

4. The utility storage mechanism of claim 1, wherein the at least one bracket includes a plurality of brackets, and wherein each of the plurality of brackets engages a respective bracket receptacle of the bracket-connection portion of the strap.

5. The utility storage mechanism of claim 1, wherein the at least one pool utility fixture includes any one or more of a group consisting of:

a pool cover;

a solar pool cover;

a pool toy storage container;

pool maintenance equipment;

a solar water heater;

pool play fixtures; and a ladder.

6. The utility storage mechanism of claim 1, wherein the at least one bracket is made of plastic.

7. The utility storage mechanism of claim 1, wherein the strap includes first and second ends that include a strap-connection feature, wherein the strap-connection feature cooperates to allow the strap to encircle the frusto-conical outer wall.

8. The utility storage mechanism of claim 7, wherein the strap-connection feature includes a hook and loop connector.

9. The utility storage mechanism of claim 1, wherein the bracket receptacle includes a pair of opposing pockets that selectively receive opposing attachment portions of the bracket.

10. A method for storing pool-related fixtures along an exterior surface of an outer wall of an inflatable pool, the method comprising steps of:

providing a strap that is adapted for placement around the exterior surface of the inflatable pool proximate a top perimeter of the inflatable pool, wherein the strap includes at least one bracket-connection portion;

tensioning the strap to allow the strap to conform to the exterior surface of the outer wall of the pool;

providing at least one bracket configured to be placed within bracket receptacles of the bracket-connection portion;

placing each of the at least one brackets into the respective bracket receptacles such that each at least one bracket is coupled with the strap and adapted to be in a substantially abutting relationship with the exterior surface of the outer wall, wherein the at least one bracket includes a receiving member that defines an engagement area; and placing a pool related fixture within the engagement area, wherein the pool related fixtures include at least one of a pool cover, a solar pool cover, a pool toy storage receptacle, pool maintenance equipment, a solar water heater, pool play fixtures, and a ladder.

11. The method of claim 10, wherein an inflatable ring extends around the top perimeter of the outer wall, and wherein an outer edge of the inflatable ring extends beyond the top perimeter.

12. The method of claim 10, wherein the outer wall includes a base defining a bottom perimeter, wherein the bottom perimeter is larger than the top perimeter, and wherein the exterior surface of the outer wall defines a frusto-conical shape.

13. The method of claim 10, wherein the at least one bracket includes a plurality of brackets, and wherein each of the plurality of brackets engages a respective bracket receptacle of the strap.

14. The method of claim 10, wherein the at least one bracket is made of plastic.

15. The method of claim 10, wherein the strap is a substantially elastic member that is adapted to be placed over the top perimeter.

16. The method of claim 10, wherein the bracket-connection portion includes a bracket receptacle that includes at least one pocket defined within the strap.

* * * * *